US005707257A

United States Patent [19]

Kotajima et al.

[11] Patent Number: 5,707,257

[45] Date of Patent: Jan. 13, 1998

[54] ELLIPTICAL BATTERY POST AND TERMINAL

[75] Inventors: Nobuhiko Kotajima, Canton; Takeshi Takahashi, Novi, both of Mich.

[73] Assignee: Yazaki Corporation, Tokyo, Japan

[21] Appl. No.: 792,178

[22] Filed: Jan. 30, 1997

[51] Int. Cl.[6] ..... H01R 4/42

[52] U.S. Cl. ..... 439/762; 439/761

[58] Field of Search ..... 439/762, 763, 439/764, 765, 754, 759, 761; 429/128

[56] References Cited

U.S. PATENT DOCUMENTS

| | | | |
|---|---|---|---|
| 4,063,794 | 12/1977 | Dittmann | 439/763 |
| 5,558,545 | 9/1996 | Staab et al. | 439/762 |
| 5,588,883 | 12/1996 | Hattori | 439/761 |

FOREIGN PATENT DOCUMENTS 5821480 5/1983 Japan .

*Primary Examiner*—Neil Abrams
*Assistant Examiner*—Bary Matthew L. Standig
*Attorney, Agent, or Firm*—Young & Basile, P.C.

[57] ABSTRACT

A battery connection comprises a battery post protruding from a battery and a battery cable terminal for clamping connection with the battery post. The battery post is an elliptical cylinder projecting perpendicularly from the surface of the battery, and the battery cable terminal has a mating elliptical clamping ring. When the clamping ring is fitted over the post and tightened therearound, the elliptical shapes of the post and terminal substantially prevent twisting of the terminal relative to the post and so inhibit loosening of the terminal. The smoothly curved, cornerless elliptical shape of the post allows the ring to slide around the perimeter of the post as the ring is tightened so that the normal contact force between the ring and the post is substantially constant around the perimeter thereof.

7 Claims, 2 Drawing Sheets

ELLIPTICAL BATTERY POST AND TERMINAL

FIELD OF THE INVENTION

This invention relates to storage batteries such as are used in automotive vehicles, and more specifically to a storage battery having a battery post of elliptical cross-section and a battery cable terminal in the form of an elliptical ring to fit matingly around the battery post.

BACKGROUND OF THE INVENTION

Automotive vehicles generally have an electrical system which includes a lead-acid storage battery. The battery has a positive and a negative terminal, and these commonly take the form of cylindrical or slightly tapered frusto-conical posts. A battery cable is connected to each of the posts by a clamp-like terminal crimped or otherwise attached to the end of the cable.

One conventionally known type of battery cable terminal comprises a hollow cylindrical ring formed from an electrically conductive metal and which is the proper size to fit around the outside of the battery post. The ring is split along an axial line so as to form a C-shape, and an arm extends from each end of the C. The distal end of one arm is crimped or otherwise attached to the battery cable, and a hole is formed in each arm adjacent the ring to receive a bolt therethrough. The ring initially has an inside diameter greater than the outside diameter of the battery post so that it may be slid over the post into surrounding relation thereto. A nut is then threaded over the end of the bolt and tightened down to urge the arms together and thereby draw the ring inwardly and into contact with the battery post.

Such a battery cable terminal is prone to inadvertent loosening or detachment from the post because the circular shapes of the post and ring offer no inherent resistance to twisting of the terminal about the axis of the post, leaving only the surface friction between the inside of the ring and the external surface of the battery post to resist twisting and hold the two components in engagement. Twisting of the terminal relative to the post can cause the terminal to work its way off of the terminal. In addition, prior art posts are often tapered, narrowing gradually from a maximum diameter adjacent the battery surface to a smaller diameter at a distal end. This is typically a one-ninth taper, and makes it even easier for the terminal to slip off of the post. It is known to provide a knurled or otherwise textured surface on the interior of the ring in order to increase the frictional engagement between the ring and the post, but such features can score or otherwise damage the soft lead or lead alloy battery posts if the terminal is twisted about the axis of the battery post.

It is possible to produce a battery post having a cross-section in the shape of a square or other polygon and a battery cable terminal having an interior opening of a complementary shape. Such a configuration will effectively resist twisting movement of the terminal relative to the battery post and so decrease the likelihood of loosening. When a polygonal terminal is tightened around a battery post of matching configuration, however, the corners of the post prevent the terminal from slipping around the perimeter of the post as the terminal is drawn tighter therearound. Accordingly, tightening of the bolt to urge the arms towards one another does not effectively draw the terminal tightly against the post around the entire perimeter, but rather produces isolated points of contact at the corners of the polygon while the flat sides of the polygon are subjected to a relatively low amount of normal force. This uneven distribution of normal contact forces about the perimeter of the post leads to less than optimum electrical contact and decreases the security of the physical connection.

SUMMARY OF THE INVENTION

The present invention is directed toward the provision of a battery post and mating battery cable terminal connection which are resistant to relative twisting movement between the two components and thus are less likely to inadvertently become disconnected from one another.

This is accomplished by a battery post in the shape of an elliptical cylinder and a battery cable terminal having a mating elliptical clamping ring. When the clamping ring is fitted over the post and tightened therearound, the elliptical shapes of the post and terminal substantially prevent twisting of the terminal relative to the post and so inhibit loosening of the terminal. The smoothly curved, cornerless elliptical shape of the post allows the ring to slide around the perimeter of the post as the ring is tightened so that the normal contact force between the ring and the post is substantially constant around the perimeter thereof.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
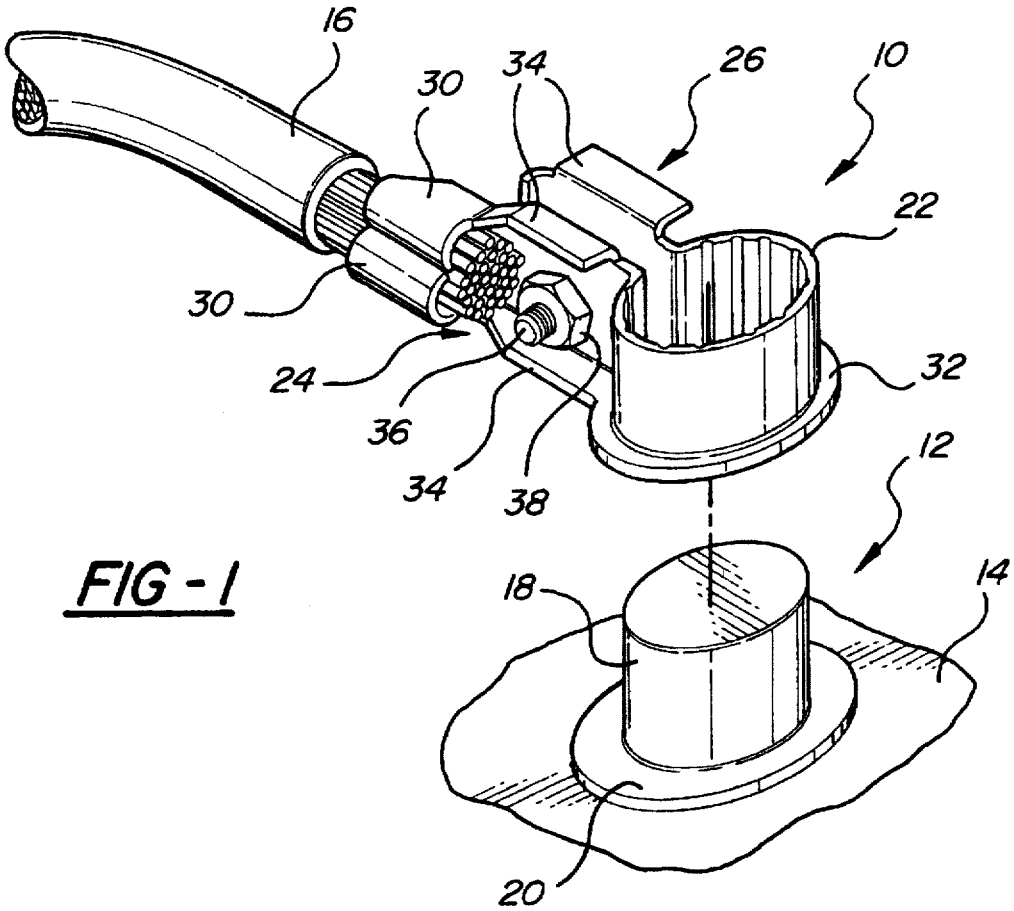
FIG. 1 is a perspective view of a battery cable terminal and battery post according to the present invention.

Referring to FIG. 1, a battery cable terminal 10 and a battery post 12 according to the present invention are shown prior to being operatively connected with one another. Battery post 12 protrudes from the surface of a lead-acid storage battery 14 such as is commonly used in automotive vehicles, and battery terminal 10 is attached to a power cable 16 which is connected to the vehicle electrical system (not shown).

Battery post 12 comprises a base 20 which lies substantially parallel with the surface of battery 14 and an elliptical cylinder 18 projecting perpendicularly from the base and the surface of battery 14. There is no taper to elliptical cylinder 18. Battery post 12 is preferably cast from lead or a lead alloy, as is well-known in the art.

The term "elliptical," as used herein, refers not strictly to a shape meeting the true geometrical definition of an ellipse, but also encompasses any oval shape having smoothly curving sides and minor and major axes.

Battery cable terminal 10 comprises an elliptical clamping ring 22 which is split along an axial line, and two parallel arms 24, 26 extending from the ends of the ring adjacent the split. In the preferred embodiment of the invention, the split is located at or near the minor axis of ellipse. A pair of crimping tabs 30 are disposed at the distal end of arm 24 and are wrapped around and securely crimped to power cable 16. Battery cable terminal 10 is preferably formed by a conventionally-known stamping process from a thin sheet of metal having good electrical conductivity and corrosion resistance, such as copper.

An annular flange 32 projects outwardly from the lower edge of clamping ring 22. Arms 24, 26 are also provided with flanges 34 projecting perpendicularly from their upper and lower edges. A bolt 36 passes through aligned holes in arms 24, 26 immediately adjacent ring 22. When bolt 36 is fully inserted through the holes, the flats of the bolt head 37 contact flanges 34 of arm 26 so that the bolt is restrained against rotation. A nut 38 is threaded over bolt 36.

Figure 2:
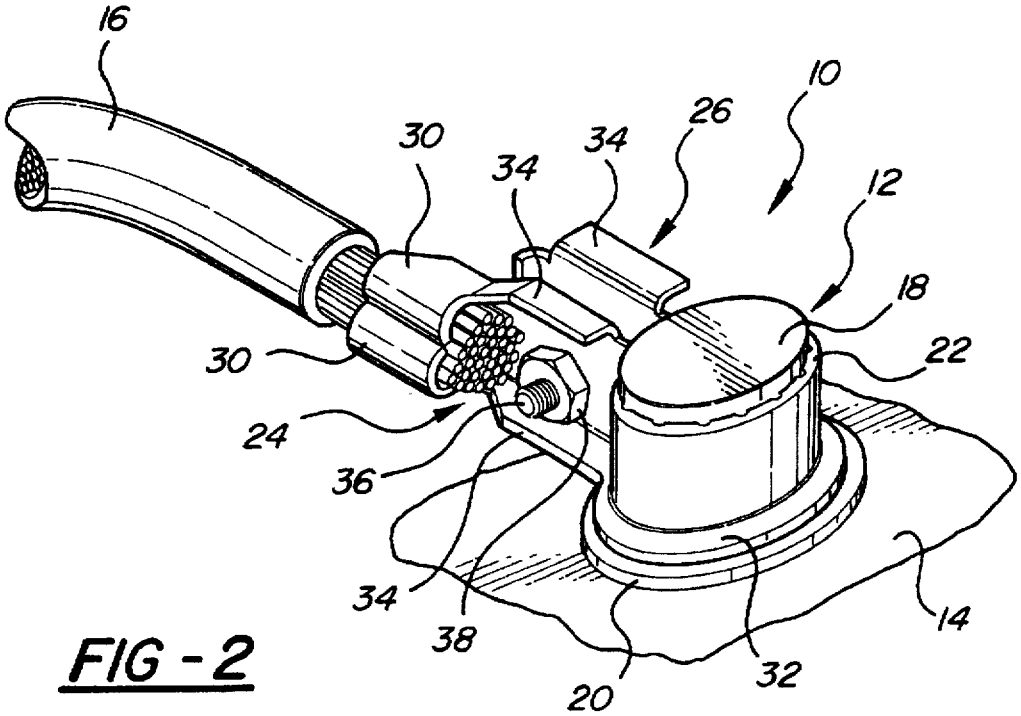
FIG. 2 is a perspective view of the battery cable terminal and battery post of FIG. 1 mated with one another.
Figure 3:
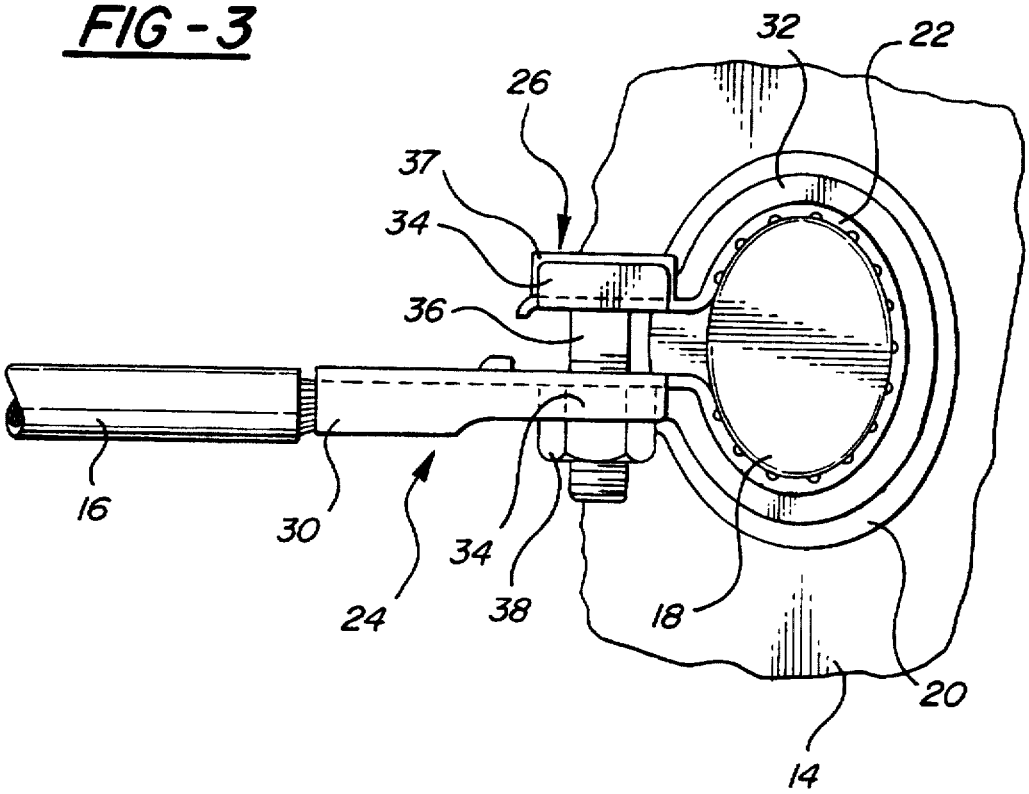
FIG. 3 is a top view of the battery cable terminal and battery post of FIG. 2.
Figure 4:
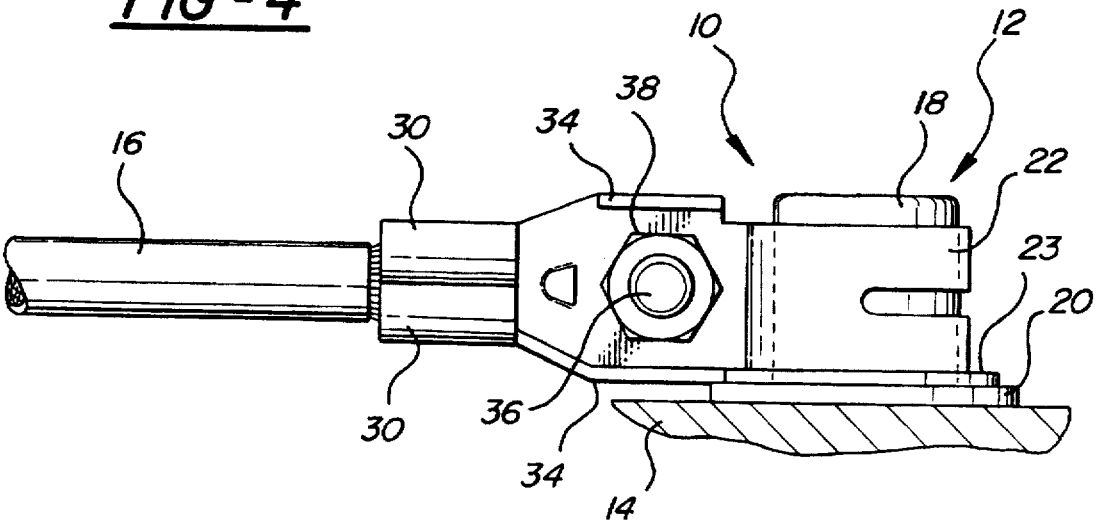
FIG. 4 is an elevation view of the battery cable terminal and battery post of FIG. 2.

As seen in FIGS. 2, 3 and 4, battery cable terminal 10 is operatively connected to battery post 12 by sliding the terminal downward over cylinder 18 to encircle the perimeter thereof and place flange 32 in contact with post base 20. Nut 38 is then tightened onto bolt 36 to urge arms 24, 26 toward one another and thereby draw clamping ring 22 inward and into contact with the circumferential surface of cylinder 18.

The smoothly curving perimeter of cylinder 18 permits clamping ring 22 to slip therearound as the ring is drawn inward, thereby producing a normal force between the contacting surfaces of the ring and the cylinder that is relatively consistent around the perimeters thereof.

When battery cable terminal 10 and battery post 12 are mated, the elliptical shape of the components serves to inhibit twisting of the terminal about the axis of the post so that the terminal is less likely to loosen inadvertently.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. In combination, a battery having a battery post projecting from a surface thereof and a battery cable terminal for connection with the post, characterized in that:

the battery post comprises an elliptical cylinder and the terminal comprises a split elliptical clamping ring for encircling the elliptical cylinder, means for drawing adjacent ends of the clamping ring toward one another to tighten the clamping ring around the elliptical cylinder, and means for connecting the clamping ring to an electric cable.

2. A battery and terminal combination according to claim 1 wherein the elliptical cylinder projects perpendicularly from the battery surface.

3. A battery and terminal combination according to claim 1 wherein the post further comprises a base from which the elliptical cylinder projects, the base lying substantially parallel with the battery surface and extending outwardly beyond a perimeter of the cylinder.

4. A battery cable terminal for use in combination with an elliptical battery post, the terminal comprising:

an elliptical clamping ring for encircling the battery post, the clamping ring being split along an axial line to define first and second ends proximate one another;

means for drawing the first and second ends of the clamping ring toward one another to tighten the clamping ring around the battery post; and means for connecting the clamping ring to an electric cable.

5. A battery cable terminal according to claim 4 further comprising first and second arms extending from the first and second ends of the clamping ring respectively.

6. A battery cable terminal according to claim 5 wherein each of the arms has a hole formed therein, and the means for drawing the ends of the clamping ring toward one another comprises a bolt for passing through the holes and a nut for threaded engagement with the bolt and tightenable to urge the arms toward one another.

7. A battery cable terminal according to claim 5 wherein the means for connecting the clamping ring to an electric cable comprises crimping tabs disposed at an end of one of the arms for engagement with the cable.

* * * * *